US010556360B2

(12) United States Patent
Exley

(10) Patent No.: US 10,556,360 B2
(45) Date of Patent: Feb. 11, 2020

(54) FLAT PAPER PUNCH

(71) Applicant: American Crafts, L.C., Lindon, UT (US)

(72) Inventor: Ross James Exley, Clifton, NJ (US)

(73) Assignee: American Crafts, L.C., Lindon, UT (US)

( * ) Notice: Subject to any disclaimer, the term of this patent is extended or adjusted under 35 U.S.C. 154(b) by 0 days.

(21) Appl. No.: 15/203,291

(22) Filed: Jul. 6, 2016

(65) Prior Publication Data

US 2016/0332320 A1 Nov. 17, 2016

Related U.S. Application Data

(63) Continuation of application No. 14/047,654, filed on Oct. 7, 2013, now abandoned, which is a continuation (Continued)

(51) Int. Cl.
*B26D 5/08* (2006.01)
*B26D 7/02* (2006.01)

(Continued)

(52) U.S. Cl.
CPC ..... *B26F 1/36* (2013.01); *B26D 3/10* (2013.01); *B26D 5/10* (2013.01); *B26F 1/32* (2013.01);

(Continued)

(58) Field of Classification Search
CPC ..... B26F 1/32; B26F 1/36; B26F 2001/4481; Y10T 83/9461; Y10T 83/9428;

(Continued)

(56) References Cited

U.S. PATENT DOCUMENTS 170,460 A 11/1875 Ashbourne
1,228,288 A 5/1917 Bower (Continued)

FOREIGN PATENT DOCUMENTS

JP 58132696 U 9/1983
JP 59082700 U 6/1984

(Continued)

OTHER PUBLICATIONS

Search Report and Written Opinion for International Application No. PCT/US2011/039990 dated Sep. 13, 2011, application now published as International Publication No. WO2011/156718 on Dec. 15, 2011.

*Primary Examiner* — Ghassem Alie
*Assistant Examiner* — Bharat C Patel
(74) *Attorney, Agent, or Firm* — Durham Jones & Pinegar, P.C., Intellectual Property Law Group

(57) ABSTRACT

A punch for punching a sheet of material, the punch having a body formed with a fissure for receiving the sheet of material, a pivot shaft defining a pivot point, and a lever pivotably mounted about said pivot shaft has an open position and a closed position. A block is provided which is positionable between the lever and the body. The body is provided with longitudinal support ridges and the lever is provided with side ridges, with the pivot point positioned in substantially the same plane as the longitudinal support ridge so that when the punch is closed, the side ridges of the lever pass outside of the support ridges of the body in a nesting relationship, allowing the punch to form a flat profile when closed.

13 Claims, 7 Drawing Sheets

Related U.S. Application Data of application No. 13/399,723, filed on Feb. 17, 2012, now Pat. No. 8,549,972, which is a continuation of application No. 12/291,666, filed on Nov. 12, 2008, now abandoned.

(51) Int. Cl.

| | |
|---|---|
| ***B26F 1/00*** | (2006.01) |
| ***B26F 1/36*** | (2006.01) |
| ***B26D 3/10*** | (2006.01) |
| ***B26D 5/10*** | (2006.01) |
| ***B26F 1/32*** | (2006.01) |
| ***B26F 1/44*** | (2006.01) |

(52) U.S. Cl.
CPC ..... *B26F 1/44* (2013.01); *B26F 2001/4481* (2013.01); *Y10T 83/7533* (2015.04); *Y10T 83/885* (2015.04); *Y10T 83/9428* (2015.04); *Y10T 83/9461* (2015.04)

(58) Field of Classification Search
CPC ..... Y10T 83/885; Y10T 83/7533; B26D 5/10; B26D 3/10
USPC ..... 83/684, 633, 459, 588, 686, 607–609, 83/634; 30/358, 362–363
See application file for complete search history.

(56) References Cited

U.S. PATENT DOCUMENTS 1,299,802 A 4/1919 Smith
1,601,414 A * 9/1926 Purple ..... G03D 15/025 292/134
1,910,294 A * 5/1933 Kaminski ..... G03D 15/025 292/134
2,232,633 A 2/1941 Richardson
2,720,157 A * 10/1955 Harrison ..... A47J 37/0611 452/144
2,780,181 A 2/1957 Roman et al.
2,799,929 A 7/1957 Kurianski
4,166,404 A 9/1979 Almog
4,180,889 A 1/1980 Joffe
D256,479 S 8/1980 Manusch
4,240,572 A 12/1980 Mitsuhashi
4,362,497 A 12/1982 Lifshitz
4,484,390 A 11/1984 Wojtowicz
4,516,923 A 5/1985 Lifshitz et al.
4,530,275 A 7/1985 Stickle et al.
4,640,451 A * 2/1987 Steiner ..... B25C 5/0214 227/120
4,729,170 A * 3/1988 Hartmeister ..... B26F 1/36 30/229
D303,812 S 10/1989 Sun
D309,916 S 8/1990 Higashi
4,951,540 A * 8/1990 Cross ..... B26D 1/305 83/397
5,005,458 A 4/1991 Merrick
5,067,242 A 11/1991 Singer
5,149,594 A 9/1992 Lewandowski et al.
D330,149 S 10/1992 Weimer
5,251,524 A 10/1993 Clifford
5,259,750 A 11/1993 Lewandowski et al.
5,303,473 A 4/1994 Sadler
5,320,011 A * 6/1994 Lee ..... B26D 7/22 30/262
D373,385 S 9/1996 Birkholz
5,601,006 A 2/1997 Quinn et al.
5,638,730 A * 6/1997 Karlis ..... B26F 1/36 30/358
5,660,105 A 8/1997 Benson et al.
5,749,278 A * 5/1998 Lee ..... B26F 1/36 83/588
D406,606 S 3/1999 Lee
D408,453 S 4/1999 Mori
D415,529 S 10/1999 Mori
6,089,137 A * 7/2000 Lee ..... B26F 1/04 30/358
6,194,017 B1 2/2001 Woodward et al.
6,209,434 B1 4/2001 Kim et al.
6,386,854 B1 5/2002 Guss
6,428,248 B1 * 8/2002 Lee ..... B26F 1/04 407/117
6,513,413 B2 * 2/2003 Lee ..... B26F 1/36 83/633
6,516,523 B1 2/2003 Lin
D477,028 S 7/2003 Huang
RE38,219 E 8/2003 Lee et al.
6,718,641 B2 4/2004 Hsuan
6,736,045 B2 5/2004 Chang
6,739,244 B1 * 5/2004 Carbaugh ..... B26F 1/04 101/28
6,742,431 B1 * 6/2004 Oh ..... B26D 7/015 30/358
6,752,058 B2 * 6/2004 Oh ..... B26D 3/10 30/358
6,863,175 B2 * 3/2005 Gelardi ..... B65D 50/045 206/1.5
6,874,189 B2 4/2005 Ackeret
6,895,842 B2 5/2005 Magnusson
6,938,542 B1 * 9/2005 Ho ..... B44B 5/0023 101/3.1
7,011,009 B1 3/2006 Tomich
D530,991 S 10/2006 West et al.
7,284,478 B2 10/2007 Lee
7,316,555 B2 1/2008 Hubener
7,343,854 B2 3/2008 Nadal-Linares et al.
7,654,183 B2 * 2/2010 Marks ..... B26D 1/08 30/189
D615,593 S 5/2010 Leung
7,856,912 B2 * 12/2010 Corcoran ..... B26D 5/10 403/321
7,882,641 B2 2/2011 Repac
7,971,513 B2 7/2011 Chan
8,549,972 B2 10/2013 Exley
2004/0007107 A1 1/2004 Bost et al.
2004/0099113 A1 5/2004 Nixon et al.
2004/0103772 A1 6/2004 Normington
2005/0039590 A1 * 2/2005 Weng ..... B26F 1/36 83/684
2005/0050740 A1 * 3/2005 Lin ..... B25B 7/04 30/363
2005/0087053 A1 * 4/2005 Yu ..... B26D 1/30 83/607
2005/0235797 A1 * 10/2005 Takada ..... B26F 1/36 83/684
2006/0228955 A1 10/2006 Rivera
2007/0006705 A1 1/2007 Oh
2007/0051221 A1 3/2007 Corcoran et al.
2007/0056422 A1 * 3/2007 Lee ..... B26F 1/22 83/582
2007/0144359 A1 6/2007 Ekberg et al.
2007/0180969 A1 * 8/2007 Kanasashi ..... B26F 1/14 83/684
2007/0221030 A1 * 9/2007 Oh ..... B26D 7/015 83/684
2007/0266836 A1 * 11/2007 Marks ..... B26D 1/08 83/684
2008/0060567 A1 * 3/2008 Aniceto ..... B26F 1/14 112/475.01
2008/0156160 A1 * 7/2008 Yamashita ..... B26F 1/36 83/459
2008/0282866 A1 11/2008 Bae
2009/0049971 A1 * 2/2009 Yamashita ..... B26D 7/015 83/468
2010/0116115 A1 5/2010 Exley

(56) References Cited

U.S. PATENT DOCUMENTS

| | | | | |
|---|---|---|---|---|
| 2011/0107889 | A1* | 5/2011 | Lee | B26D 7/1818 83/168 |
| 2014/0165810 | A1 | 6/2014 | Exley | |

FOREIGN PATENT DOCUMENTS

| | | | |
|---|---|---|---|
| JP | 59205300 | A | 11/1984 |
| JP | 60029100 | U | 2/1985 |
| JP | 60103699 | U | 7/1985 |
| JP | 62048497 | A | 3/1987 |
| JP | 62072098 | U | 5/1987 |
| JP | 62188397 | U | 11/1987 |
| JP | 63057099 | U | 4/1988 |
| JP | 01135498 | A | 5/1989 |
| JP | 04115900 | A | 4/1992 |
| JP | 05200699 | A | 8/1993 |
| JP | 06226692 | A | 8/1994 |
| JP | 07227797 | A | 8/1995 |
| JP | 09155795 | A | 6/1997 |
| JP | 09155796 | A | 6/1997 |
| JP | 10076498 | A | 3/1998 |
| JP | 2000042998 | A | 2/2000 |
| JP | 2001157995 | A | 6/2001 |
| JP | 2002001698 | A | 1/2002 |
| JP | 2002001699 | A | 1/2002 |
| JP | 2002331496 | A | 11/2002 |
| JP | 2006082204 | A | 3/2006 |
| JP | 2006198684 | A | 8/2006 |
| JP | 2008110468 | A | 5/2008 |
| JP | 2008246652 | A | 10/2008 |
| JP | 2010280017 | A | 12/2010 |
| JP | 2011045997 | A | 3/2011 |
| WO | WO-2008046076 | A2 | 4/2008 |

* cited by examiner

FLAT PAPER PUNCH

CROSS-REFERENCE TO RELATED APPLICATION

This application is a continuation of U.S. patent application Ser. No. 14/047,654 filed Oct. 7, 2013, now abandoned, which is a continuation of U.S. patent application Ser. No. 13/399,723 filed Feb. 17, 2012, now U.S. Pat. No. 8,549,972, which is a continuation of U.S. patent application Ser. No. 12/291,666 filed Nov. 12, 2008, now abandoned, each of which is incorporated herein by reference in its entirety.

TECHNICAL FIELD

This application relates to hole punchers. More particularly, the present invention relates to a compact, flat design punch with improved construction for punching a desired shape into sheet material.

BACKGROUND

A common scrapbooking accessory is the manual punch for punching sheet material so that a desired shape may be punched in a sheet material.

An improvement in the field of craft punches are mold pressing devices used to speed the task of punching shapes from paper sheets. Such devices include lever punches, which typically have a pressing lever that is pivotally disposed on a seat body for pressing a mold block, or palm punches, which typically rely on a user's palm to push down in an axial direction on the block in order to create a desired shape on a sheet of paper. With either of these two types of punches, a paper or a sheet can be inserted into or positioned within the fissure of the punch, and then a pressing action is applied, either by pushing the lever with a user's thumb or hand or directly to the block with the user's palm. This causes a mold block to be forced downward, resulting in the die punching a corresponding shape on the paper or the sheet placed in the fissure.

Using these prior art devices, many products with the shape, as that of the die, can be formed with a typical user having to store each mold pressing device so that when a suitable shape is desired, the appropriate mold pressing device is located and utilized. However, a drawback to a large collection of mold pressing devices, including both lever and palm type punch devices, is their relative bulkiness, leading to a disorganized and disheveled collection of both lever and palm mold pressing devices.

SUMMARY

The present invention looks to overcome the drawbacks associated with the prior art by providing an improved flat lever punch design.

A first aspect is a compact mold punch design in which the internal components of the punch are configured so that the lever of the punch can be positioned in a closed position that is substantially parallel to the fissure.

Another aspect is a locking assembly that, when the lever is in a closed position, the locking assembly can retain the lever in a closed locked position, allowing the punch to be stored in a convenient and efficient manner, while simultaneously allowing the user to quickly recognize and locate a desired punch within a large group of similar punches.

A further aspect is a punch that can be stored in an upright manner on a flattened nose surface so that the punch rests in a substantially vertical orientation.

Such an arrangement includes a punch for punching designs into a sheet media, where the profile of the punch is substantially flat. This reduces the size of the punch, making it easier to store. A locking assembly maintains the flat shape of the punch when the punch is not in use.

In one arrangement, the nose of the punch is flattened, so that when not in use, the punch may be punch may be stored vertically—on a work surface, for example—so that a user may easily store and identify the shapes (punched by the punch) by viewing the indicia on the housing.

In another arrangement, the punch block of the punch that presses through the punch body to form the punched shape is fashioned with three shoulders for housing three springs for connecting the punch block to the punch body in a spring biased relationship. This provides a more stable punch block arrangement and prevents the springs from getting in the way of the punch body and the lever so that the punch may retain its flat profile.

To this end, a punch for punching a sheet of material according to this disclosure includes a punch body formed with a fissure for receiving the sheet of material and a pivot coupling defining a pivot point. A lever is pivotably mounted about the pivot point of the pivot coupling so that a punch block may be positionable between the lever and the punch body. The punch block is provided with a die movable along a first axis, with the punch block having first, second, and third shoulders. These shoulders respectively engage first, second, and third resilient members, springs, compression fittings, or biasing devices with the resilient members being disposed adjacent to the die and disposed between the first, second, and third shoulders of the punch block and the punch body. When the punch block is positioned between the lever and the punch body, and when the lever is pivoted about the pivot point between an open position and a punching position, the lever engages the punch block with the axially moveable die to punch the sheet of material.

BRIEF DESCRIPTION OF THE DRAWINGS

Embodiments of the disclosure can be understood through the following description and accompanying drawings, wherein.

DETAILED DESCRIPTION

Figure 3:
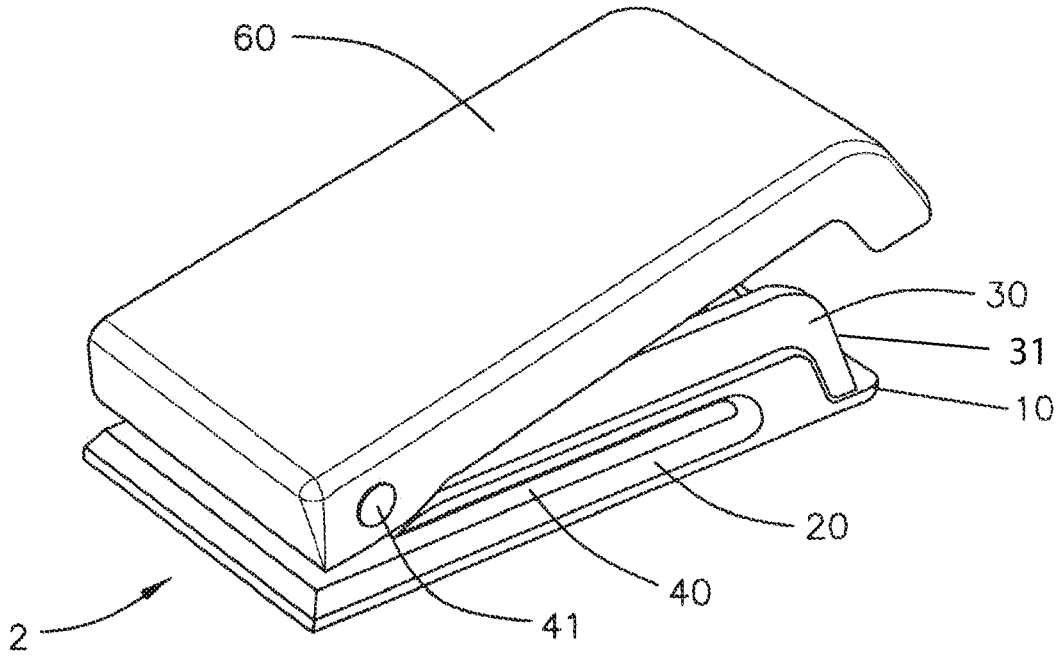
FIG. 3 is a perspective view of a punch device having a punch body as shown in FIG. 1, with the lever thereon, in an open position, in accordance with one embodiment.

In one embodiment of the present invention as shown in FIG. 3, a punch device 2 includes a punch body 10. Punch body 10 has a lower portion 20, an upper portion 30, a lever 60, and a fissure 40 between the upper portion 30 and the lower portion 20.

Figure 1A:
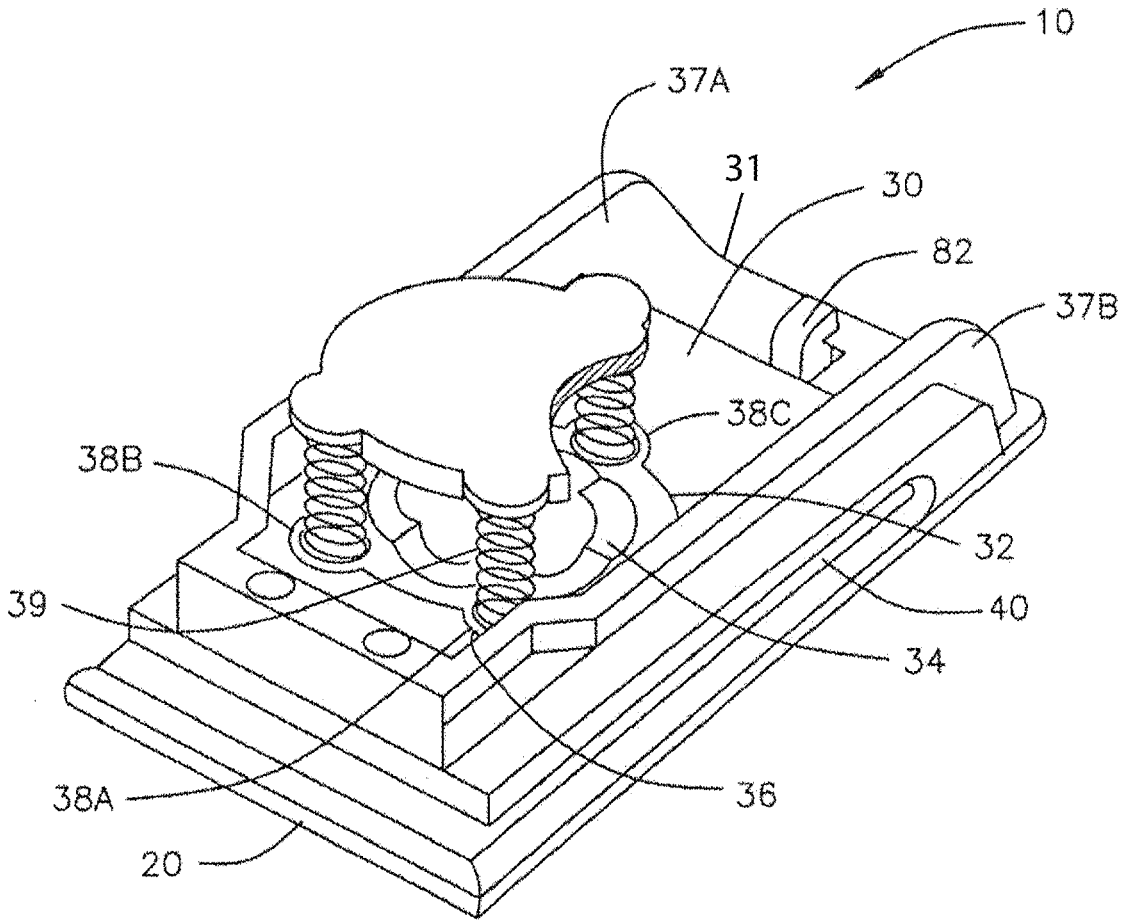
FIG. 1A shows the partially disassembled upper perspective view of the punch body with the lever removed, in accordance with one embodiment.
Figure 1B:
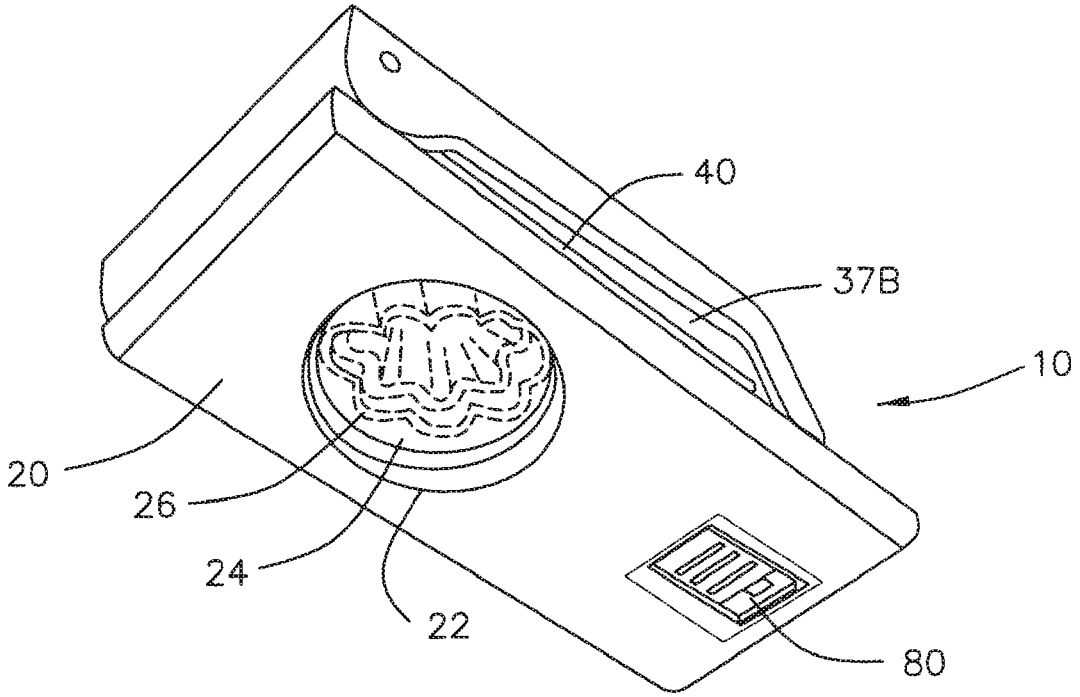
FIG. 1B shows the lower perspective views of the punch body, in accordance with one embodiment.

The lower portion 20 of the punch body 10 forms the primary platform for the punch device 2, providing a substantially flat surface 21 to rest the punch device 2 on a table or the like. Referring to FIGS. 1A and 1B, the lower portion 20 of the punch body 10 includes a lower opening 22 configured to support a shaped die 24. The shaped die 24 includes at least one shaped edge 26 that ultimately corresponds to the shape to be cut from a sheet media placed into the punch device 2. Although a clover shaped die is shown, it is known to those skilled in the art that any such shaped die may be substituted.

The upper portion 30 of the punch body 10 also includes an upper opening 32 capable of receiving and supporting a block support element 34. The upper opening 32 and the block support element 34 are substantially aligned over the lower opening 22 and the shaped die 24, supported by the lower opening 22 of the lower portion 20 of the punch body 10. The block support element 34, which may be made of a metal material, has a shaped opening 36 and three openings 38A, 38B and 38C, each for supporting a resilient member 39 (such as a spring). A pair of structural longitudinal edges 37A and 37B run along the length of the upper portion 30 and form the side boundaries of this portion. In one embodiment, the pair of structural longitudinal edges 37A and 37B are spaced apart in this embodiment, approximately 4 centimeters.

As shown in FIG. 1A, openings 38A, 38B and 38C are positioned around the outer circumference of the block support element 34. In one advantageous arrangement of the present invention, openings 38A and 38B are located relatively close to one another in the front 31 of the upper portion 30 of the punch body 10, close to the opening side of the fissure 40, linearly arranged in a manner that is substantially parallel to the front surface of the upper and lower portions 30 and 20 of the punch body 10. In one arrangement, openings 38A and 38B are placed substantially about 60 degrees apart from one another.

The other opening 38C is located at the position distal to the front surface of the upper and lower portions 30 and 20 of the punch body 10. In one arrangement, the opening 38C is substantially 150 degrees separated from both opening 38A and opening 38B.

As shown in FIGS. 1A and 1B, the thickness and height of the upper portion 30 of the punch body 10 is such that it is a substantially flat profile, parallel to lower portion 20. Such an arrangement at least partially provides a basis for the substantially flat profile of the punch device 2.

In one embodiment of the present invention as shown in FIGS. 1A and 1B, a locking mechanism 80, such as a slide lock, is accessible from the base of the lower portion 20 of the punch body 10, with a hook latch 82, connected thereto, which is able to secure the lever 60 into a closed position, as explained below.

Figure 2:
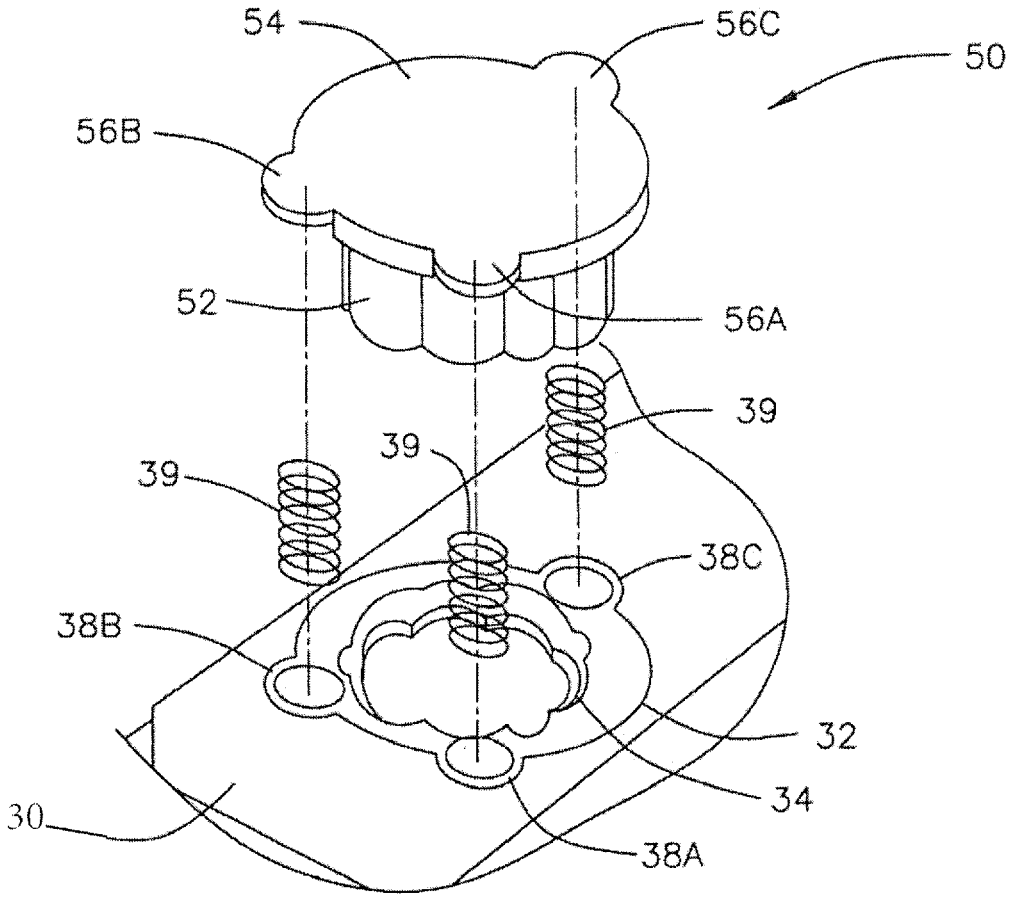
FIG. 2 is a view of the punch block positioned over the opening in the punch body of FIG. 1, in accordance with one embodiment.

As shown in FIG. 2, a punch block 50 is shown, in an exploded view of the punch device 2, above the upper opening 32 and the block support element 34. The punch block 50 has a shaped punch 52 corresponding to shaped edge 26 of shaped die 24. The shaped punch 52 has a flattened top 54, with three shoulders 56A, 56B and 56C corresponding to openings 38A, 38B and 38C respectively, with shoulder 56A not shown, as it is behind shoulder 56B. As shown in FIG. 2, between each opening 38A, 38B, 38C and each shoulder 56A, 56B, 56C, a resilient member 39 is positioned such that the punch block 50 is resiliently supported above the upper opening 32 of the upper portion 30. As is further shown in FIG. 2, shoulders 56A, 56B and 56C are elevated relative to the flattened top 54 to both receive the resilient member 39 and so that the lever 60 may nest within shoulders 56A, 56B and 56C and make contact with the flattened top 54.

Figure 4:
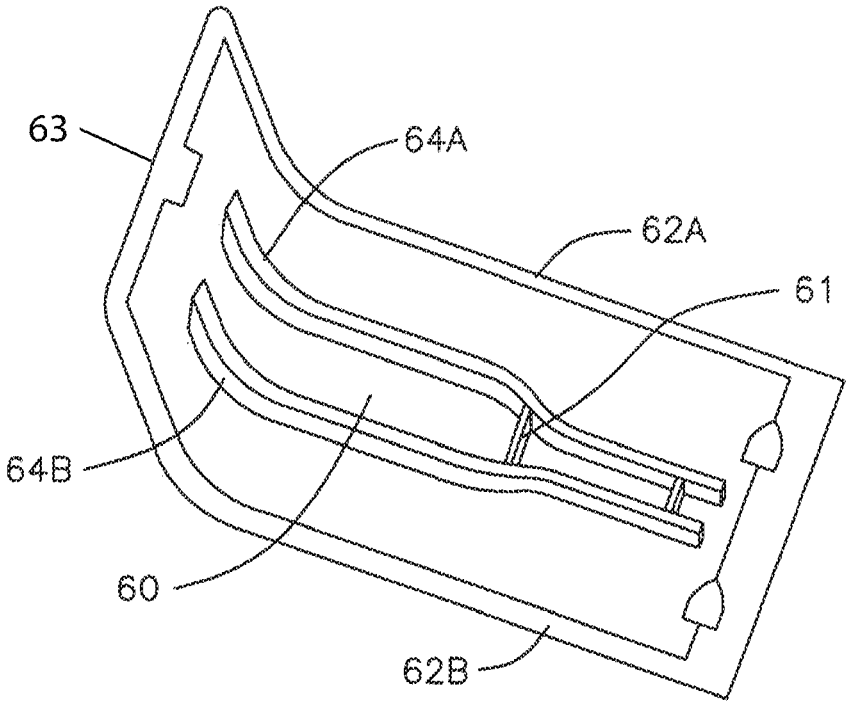
FIG. 4 is a bottom view of the dissembled lever as shown in FIG. 3, in accordance with one embodiment.
Figure 5:
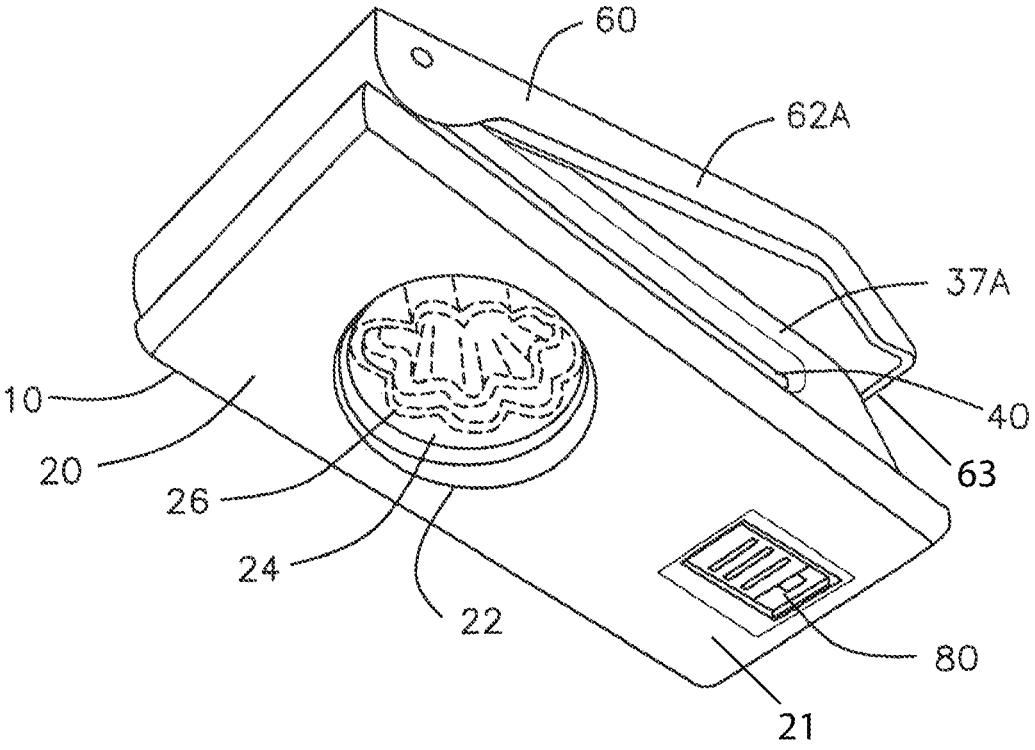
FIG. 5 is a view of the punch device from FIG. 3 in an open position and in accordance with another embodiment.

As shown in FIGS. 1A and 1B, as well as FIGS. 3 and 4, a lever 60 is pivotably coupled to the front edge of the upper portion 30 of the punch body 10 by a pivot coupling 41, such as a metal rod attached transversely across the front end (by the fissure 40 opening) of the upper portion 30 of the punch body 10. The position of the pivot coupling 41 in substantially the same horizontal plane as the pair of the structural longitudinal edges 37A and 37B allows the punch device 2 to maintain its flat profile by keeping the front (nose 63) portion of the lever 60 relatively parallel to the punch body 10. In the open position as shown in FIG. 3, the underside of the lever 60 rests on an upper surface 53 of the flattened top 54 of the punch block 50, and nests within shoulders 56A, 56B and 56C. As described below, the underside of the lever 60 has a raised bump 61 that makes contact with the flattened top 54.

As shown in FIG. 4, the lever 60 is generally hollow in shape, having two longitudinal support edges 62A and 62B and a central longitudinal ridge pair 64A and 64B which are closer together towards the front of the upper portion 30 (near the pivot coupling 41) and separate for stability as they progress towards the opposite side of the upper portion 30. Longitudinal support edges 62A and 62B are spaced apart so that they may cover and enclose a pair of structural longitudinal edges 37A and 37B, which, as set forth above, have a dimension of approximately 4 centimeters. In one arrangement of the invention, the longitudinal support edges 62A and 62B are spaced apart at a distance slightly greater than 4 cm.

The bottoms of the central longitudinal ridge pair 64A and 64B, at the point where they are close together, rest on flattened top 54 of punch block 50 and form the portion of lever 60, raised bump 61 that physically contacts upper surface 53 of flattened top 54 of punch block 50.

As shown in FIGS. 3-6, the lever 60, along with the longitudinal support edges 62A and 62B and the central longitudinal ridge pair 64A and 64B, may be profiled in a substantially flat arrangement. In such a manner, when closed, the central longitudinal ridge pair 64A and 64B and the longitudinal support edges 62A and 62B of the lever 60 and the pair of structural longitudinal edges 37A and 37B of the upper portion 30 pass by one another in a nesting arrangement.

Figure 6:
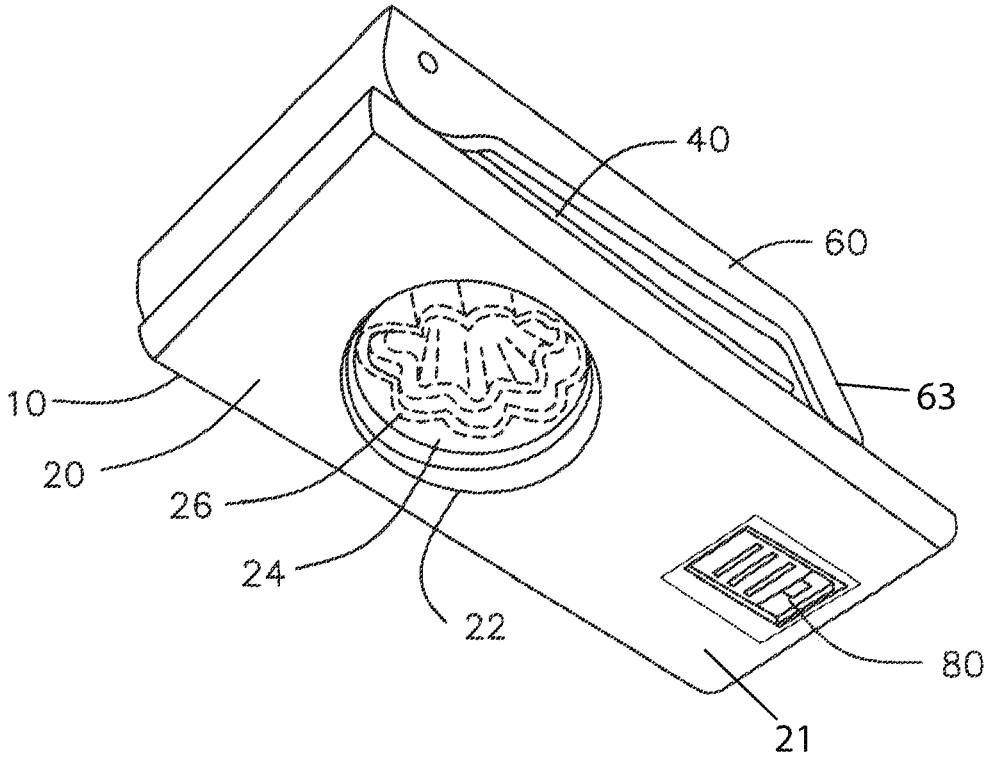
FIG. 6 is a view of the punch device from FIG. 3 in a closed locked position; in accordance with another embodiment.

In the closed position shown in FIG. 6, the hook latch 82 (FIG. 1A) of the locking mechanism 80 is engaged so that it connects against a portion of the inside of the lever 60 so as to maintain the punch device 2 in a closed position.

The invention claimed is:

1. A punch capable of punching a sheet of material, the punch comprising:

a punch body having a bottom portion with a surface upon which the punch body rests during use of the punch, an upper portion over the bottom portion, and a fissure, laterally disposed between the bottom portion and the upper portion and capable of receiving the sheet of material;

a lever pivotably coupled adjacent to a rear of the punch body, the lever having an open position in which a nose of the lever is spaced apart from a front of the upper portion of the punch body and a closed position in which the nose is adjacent to the front of the upper portion of the punch body and the lever is oriented parallel to an orientation of the punch body, the nose including an underside with a receptacle; a punch block;

having an upper surface, the punch block positionable between the lever and the punch body and movable along a first axis generally perpendicular to the fissure; and a locking mechanism accessible and operable from the surface upon which the punch body rests during use of the punch, the locking mechanism comprising a slide at least partially recessed in a front of the bottom portion of the punch and a hook latch associated with the slide, the slide being movable between an unlocked position and a locking position, the hook latch capable of engaging the receptacle of the lever when the lever is depressed to the closed position.

2. The punch of claim 1, wherein, when the slide of the locking mechanism is in the locking position, the hook latch secures the lever in the closed position and prevents the lever from moving to the open position.

3. The punch of claim 2, wherein, when the slide of the locking mechanism is in the locking position, the hook latch engages the receptacle of the lever.

4. The punch of claim 2, wherein, when the slide of the locking mechanism is in the locking position, the hook latch engages a portion of an inner surface of the lever.

5. The punch of claim 1, further comprising a raised bump on an underside of the that engages the punch block when the lever is pivoted to the closed position.

6. The punch of claim 1, wherein the punch block comprises:

a flattened top with a flat upper surface and a lower surface;

a shaped punch extending from the lower surface of the flattened top;

a plurality of shoulders extending peripherally from the flattened top; and a plurality of resilient members, each resilient member of the plurality of resilient members positioned between a lower surface of a shoulder of the plurality of shoulders and an inner surface of the punch body, the lever capable of engaging the flat upper surface of the flattened top upon movement of the lever from the open position to the closed position to cause the shaped punch to move axially through an opening in the punch body.

7. The punch of claim 6, wherein each shoulder of the plurality of shoulders of the punch block is raised relative to the flat upper surface of the flattened top of the punch block.

8. The punch of claim 6, wherein the punch block is positioned above a die carried by the bottom portion of the punch body.

9. A punch capable of punching a sheet of material, the punch comprising:

a punch body having a bottom portion with a surface upon which the punch body rests during use of the punch, an upper portion over the bottom portion, and a fissure, laterally disposed between the lower bottom portion and the upper portion and capable of receiving the sheet of material;

a lever pivotably coupled to the punch body adjacent to a rear of the punch body, the lever having an open position in which a nose of the lever is spaced apart from a front of the upper portion of the punch body and a closed position in which the nose of the lever is adjacent to the front of the upper portion of the punch body and the lever is oriented over the punch body substantially parallel to the punch body, the nose of the lever including an underside with a receptacle;

a punch block having an upper surface, the punch block positionable between the lever and the punch body and movable along a first axis generally perpendicular to the fissure; and a locking mechanism accessible and operable from a bottom surface of the punch body, the locking mechanism comprising a slide and a hook latch, the slide at least partially recessed in a front of the bottom surface of the punch body and movable between an unlocked position and a locking position, movement of the slide to the locking position enabling the hook latch to secure the lever in the closed position by engaging the receptacle of the lever and preventing the lever from moving to the open position.

10. The punch of claim 9, wherein a raised bump on an underside of the lever can contact the punch block when the lever is pivoted from the open position to the closed position.

11. The punch of claim 9, wherein the punch block includes:

a flattened top with a flat upper surface and a lower surface;

a shaped punch extending from the lower surface of the flattened top;

at least one resilient member positioned between the flattened top and corresponding feature of the punch body, movement of the lever to the closed position capable of causing the punch block to move axially through an opening through the punch body.

12. The punch of claim 11, wherein the flattened top of the punch block includes at least one shoulder capable of retaining a portion of a resilient member.

13. The punch of 12, wherein the punch body is capable of retaining another portion of the resilient member.

* * * * *